US006907930B2

(12) United States Patent
Cavender et al.

(10) Patent No.: US 6,907,930 B2
(45) Date of Patent: Jun. 21, 2005

(54) MULTILATERAL WELL CONSTRUCTION AND SAND CONTROL COMPLETION

(75) Inventors: Travis W. Cavender, Angleton, TX (US); Thomas O. Roane, Corinth, TX (US); Neil Hepburn, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 153 days.

(21) Appl. No.: 10/356,334

(22) Filed: Jan. 31, 2003

(65) Prior Publication Data

US 2004/0149444 A1 Aug. 5, 2004

(51) Int. Cl.[7] ..... E21B 43/00
(52) U.S. Cl. ..... 166/313; 166/242.3; 166/50
(58) Field of Search ..... 156/313, 380, 156/387, 242.6, 242.3, 385, 50

(56) References Cited

U.S. PATENT DOCUMENTS

| | | | | |
|---|---|---|---|---|
| 5,035,285 A | | 7/1991 | Dickinson et al. | |
| 5,318,121 A | | 6/1994 | Brockman et al. | |
| 5,526,880 A | | 6/1996 | Jordan, Jr. et al. | |
| 5,746,274 A | | 5/1998 | Voll et al. | |
| 5,884,704 A | * | 3/1999 | Longbottom et al. | 166/313 |
| 5,992,524 A | | 11/1999 | Graham | |
| 6,089,320 A | | 7/2000 | LaGrange | |
| 6,125,937 A | * | 10/2000 | Longbottom et al. | 166/313 |
| 6,158,513 A | * | 12/2000 | Nistor et al. | 166/313 |
| 6,158,514 A | * | 12/2000 | Gano et al. | 166/313 |
| 6,189,616 B1 | * | 2/2001 | Gano et al. | 166/298 |
| 6,196,321 B1 | * | 3/2001 | Gano | 166/313 |
| 6,263,968 B1 | | 7/2001 | Freeman et al. | |
| 6,439,312 B1 | | 8/2002 | Hess et al. | |
| 2002/0112857 A1 | * | 8/2002 | Ohmer et al. | 166/313 |
| 2002/0125008 A1 | * | 9/2002 | Wetzel et al. | 166/278 |

FOREIGN PATENT DOCUMENTS

| | | |
|---|---|---|
| EP | 0859121 | 8/1998 |
| EP | 0927811 | 7/1999 |

OTHER PUBLICATIONS

Pending U.S. Appl. No. 10/103,381, filed Mar. 21, 2002.
Pending U.S. Appl. No. 10/191,086, filed Jul. 9, 2002.
Pending U.S. Appl. No. 10/083,020, filed Feb. 26, 2002.
Sperry–Sun Drilling Services, "Multilateral Products, Services, and Solutions", undated.
Sperry–Sun Drilling Services, "Multilateral Services Profile", dated 2000.
Search Report for United Kingdom application GB 0401836.2.

* cited by examiner

*Primary Examiner*—David Bagnell
*Assistant Examiner*—Daniel P Stephenson
(74) *Attorney, Agent, or Firm*—Marlin R. Smith

(57) ABSTRACT

A multilateral well construction and sand control completion. In a described embodiment, a well completion includes first and second wellbores intersecting at an intersection; an assembly positioned in the second wellbore, the assembly including a packer and a well screen, the packer being sealingly engaged with the second wellbore; and a wellbore connector sealingly connected to the assembly, the wellbore connector also being sealingly engaged in the first wellbore on opposite sides of the intersection, and the wellbore connector isolating the intersection from fluid flow through the assembly in the second wellbore and from fluid flowing through the wellbore connector between the opposite sides of the intersection.

20 Claims, 9 Drawing Sheets

MULTILATERAL WELL CONSTRUCTION AND SAND CONTROL COMPLETION

BACKGROUND

The present invention relates generally to operations performed and equipment utilized in conjunction with a subterranean well and, in an embodiment described herein, more particularly provides a multilateral well construction and sand control completion.

In multilateral wells (i.e., wells having at least one intersection between wellbores) it is desirable to isolate the wellbore intersection from fluids produced from the wellbores when the intersection occurs in a formation in communication with the intersection. Such isolation achieved by seals, packers, tubular strings, etc. within the wellbores results in a wellbore junction known to those skilled in the art as a TAML level 5 junction.

It is sometimes desirable to provide sand control in one or more of the intersecting wellbores. For this purpose, well screens have been used in the wellbores and some techniques have been developed for gravel packing and/or performing stimulation operations in the wellbores. However, these existing techniques typically require many trips into the well, and are thus costly and time-consuming to perform, or do not result in at least a TAML level 5 junction being formed.

From the foregoing, it can be seen that it would be quite desirable to provide improvements in multilateral well construction and sand control completions.

SUMMARY

In carrying out the principles of the present invention, in accordance with an embodiment thereof, a well completion is provided which addresses the above problems in the art.

In one aspect of the invention, a well completion is provided which includes first and second wellbores intersecting at an intersection. An assembly is positioned in the second wellbore. The assembly includes a packer and a well screen. The packer is sealingly engaged with the second wellbore.

A wellbore connector is sealingly connected to the assembly. The wellbore connector is also sealingly engaged in the first wellbore on opposite sides of the intersection. The wellbore connector isolates the intersection from fluid flow through the assembly in the second wellbore and from fluid flowing through the wellbore connector between the opposite sides of the intersection.

In another aspect of the invention, a well completion is provided which includes first and second wellbores intersecting at an intersection. An expandable well screen is positioned in the second wellbore. A wellbore connector is connected to the screen. The wellbore connector is also sealingly engaged in the first wellbore on opposite sides of the intersection. The wellbore connector isolates the intersection from fluid flow through the screen in the second wellbore and from fluid flowing through the wellbore connector between the opposite sides of the intersection.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
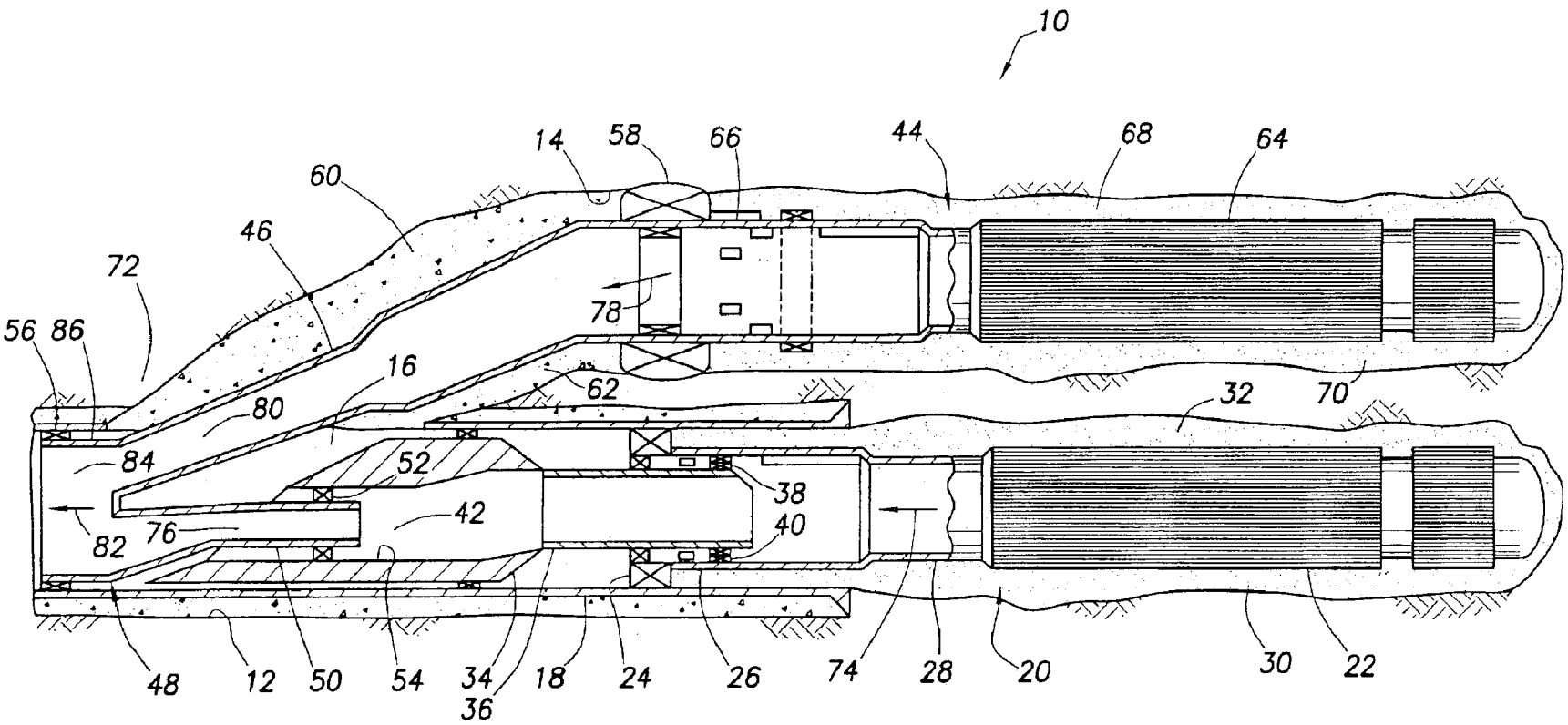
FIG. 1 is a schematic cross-sectional view of a first method embodying principles of the present invention.

Representatively and schematically illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, the method 10 has resulted in the construction and completion of a main or parent wellbore 12 and a lateral or branch wellbore 14. The wellbores 12, 14 intersect at an intersection 16, which is formed by positioning a milling/drilling whipstock (not shown in FIG. 1) in the main wellbore 12 below the intersection, and then using the whipstock to laterally deflect mills, drills, etc. to cut through casing 18 lining the main wellbore and drill the branch wellbore extending outwardly from the intersection. Such techniques of forming wellbore intersections are well known to those skilled in the art.

However, it should be clearly understood that other techniques for forming the wellbore intersection 16 may be used in keeping with the principles of the invention. For example, both the wellbore 14 and the lower portion of the wellbore 12 could branch outwardly from the upper portion of the wellbore 12, etc. Thus, it will be appreciated that the invention is not limited to the specific details of the various embodiments described herein. Instead, the invention permits a wide variety of alternate methods and configurations.

After the wellbores 12, 14 have been formed, the milling/drilling whipstock is retrieved from the well, and the lower portion of the wellbore 12 is completed as shown in FIG. 1. Specifically, a gravel packing assembly 20 is installed in the wellbore 12, and the wellbore is gravel packed about the assembly to provide sand control. The assembly 20 as depicted in FIG. 1 includes one or more well screens 22, a packer 24 and a slurry discharge device 26 interconnected in a tubular string 28.

Preferably, the elements of the gravel packing assembly 20 are arranged as depicted in FIG. 1, with the discharge device 26 positioned between the packer 24 and the screens 22, but other configurations may be utilized, if desired. The packer 24 is set in the casing 18 below the intersection 16, and gravel and/or proppant 30 is discharged into an annulus 32 between the assembly 20 and the wellbore 12, using techniques well known to those skilled in the art.

Note that it is not necessary for the lower portion of the wellbore 12 to be gravel packed in keeping with the principles of the invention. For example, a formation fracturing operation or other stimulation operation, with or without also gravel packing, could be performed in the lower portion of the wellbore 12. As another example, the screens 22 could be installed in the lower portion of the wellbore 12 without gravel packing or fracturing, the screens could be expanded in the lower portion of the wellbore as described below, or the lower portion of the wellbore could be completed in some other manner, if desired.

After gravel packing the lower portion of the wellbore 12, a deflector 34 is installed in the wellbore 12 below the intersection 16. A tubular tailpipe 36 attached to the deflector 34 is stung into an upper end of the assembly 20 and is sealingly engaged therewith, for example, with seals 38 received in seal bores 40. As a result, a passage 42 formed through the deflector 34 is in sealed communication with the interior of the assembly 20 via the tailpipe 36.

Alternatively, the deflector 34 could be used in place of the milling/drilling whipstock, in which case the deflector 34 would be installed in the wellbore 12 prior to drilling the branch wellbore 14. This alternative also eliminates the step of retrieving the drilling/milling whipstock from the well after the branch wellbore 14 is drilled. In this case, it is preferred that the lower main wellbore 12 be completed (i.e., by installing the gravel packing assembly 20 and packing gravel about the screen 22) prior to installing the deflector 34 and drilling the branch wellbore 14. Thus it will be appreciated that the specific order of steps in the methods as described herein, and the specific equipment utilized in these steps, may be altered without departing from the principles of the invention.

In a unique aspect of the method 10, the branch wellbore 14 is then completed and the wellbore intersection 16 is isolated from fluid flows in the wellbores 12, 14 in only a single trip into the well. Specifically, another gravel packing assembly 44 is attached to a tubular leg 46 of a wellbore connector 48 and conveyed into the well. The wellbore connector 48 is preferably of the type described in U.S. Pat. No. 6,089,320, the entire disclosure of which is incorporated herein by this reference.

The assembly 44 deflects laterally off of the deflector 34 and enters the wellbore 14. Another tubular leg 50 of the wellbore connector 48 is not deflected off of the deflector 34, but instead is sized so that it enters the passage 42 in the deflector. The leg 50 is sealingly engaged in the passage 42, for example, using seals 52 inserted into a seal bore 54. A packer or hanger 56 at an upper end of the wellbore connector 48 anchors the wellbore connector and seals between the casing 18 and the wellbore connector.

The assembly 44 includes an inflatable packer 58, which is set in the wellbore 14 using techniques well known to those skilled in the art. For example, a ball or other plugging device may be pumped down to the packer 58, and pressure applied to set the packer. Cement 60 may be flowed into an annulus 62 above the packer 58 and between the leg 46 and the wellbore 14, if desired, using cement staging equipment and techniques well known to those skilled in the art. One situation in which use of the cement 60 may be desired is when a fracturing operation is to be performed in the wellbore 14.

The assembly 44 is very similar to the assembly 20 described above, in that it includes the packer 58, one or more screens 64 and a slurry discharge device 66 between the packer and screens. Of course, other configurations of the assembly 44 may be used without departing from the principles of the invention. Gravel and/or proppant 68 is discharged into an annulus 70 between the assembly 44 and the wellbore 14 using techniques well known to those skilled in the art.

Note that it is not necessary for the branch wellbore 14 to be gravel packed in keeping with the principles of the invention. For example, a formation fracturing operation or other stimulation operation, with or without also gravel packing, could be performed in the branch wellbore 14. As another example, the screens 64 could be installed in the branch wellbore 14 without gravel packing or fracturing, the screens could be expanded in the lower portion of the wellbore as described below, or the wellbore could be completed in some other manner, if desired.

It may now be fully appreciated that the method 10 results in the isolation of the intersection 16 (and a formation 72 surrounding the intersection) from fluid flowing between the wellbore connector 48 and each of the assemblies 44, 20. Specifically, fluid (indicated by arrow 74) flowing from the assembly 20 enters a passage 76 in the leg 50, and fluid (indicated by arrow 78) flowing from the assembly 44 enters a passage 80 in the leg 46 of the wellbore connector 48.

The fluid flows 74, 78 are commingled in the wellbore connector 48 and the commingled fluid (indicated by arrow 82) flows upwardly through a passage 84 extending through an upper tubular end 86 of the wellbore connector. Alternatively, the fluid flows 74, 78 could be maintained separate and not commingled in the wellbore connector 48, if desired, by providing separate tubular strings for these flows, by using "intelligent" completion techniques, etc.

Each of these fluid flows 74, 78 is isolated from the intersection 16 and the formation 72. The packer 24 isolates the fluid 74 produced through the assembly 20 from fluid in other zones intersected by the main wellbore 12. The packer 58 isolates the fluid 78 produced through the assembly 44 from fluid in other zones intersected by the branch wellbore 14. Thus, the method 10 provides a single trip gravel packed completion of the branch wellbore 14, while also achieving a TAML level 5 wellbore junction.

Figure 2A:
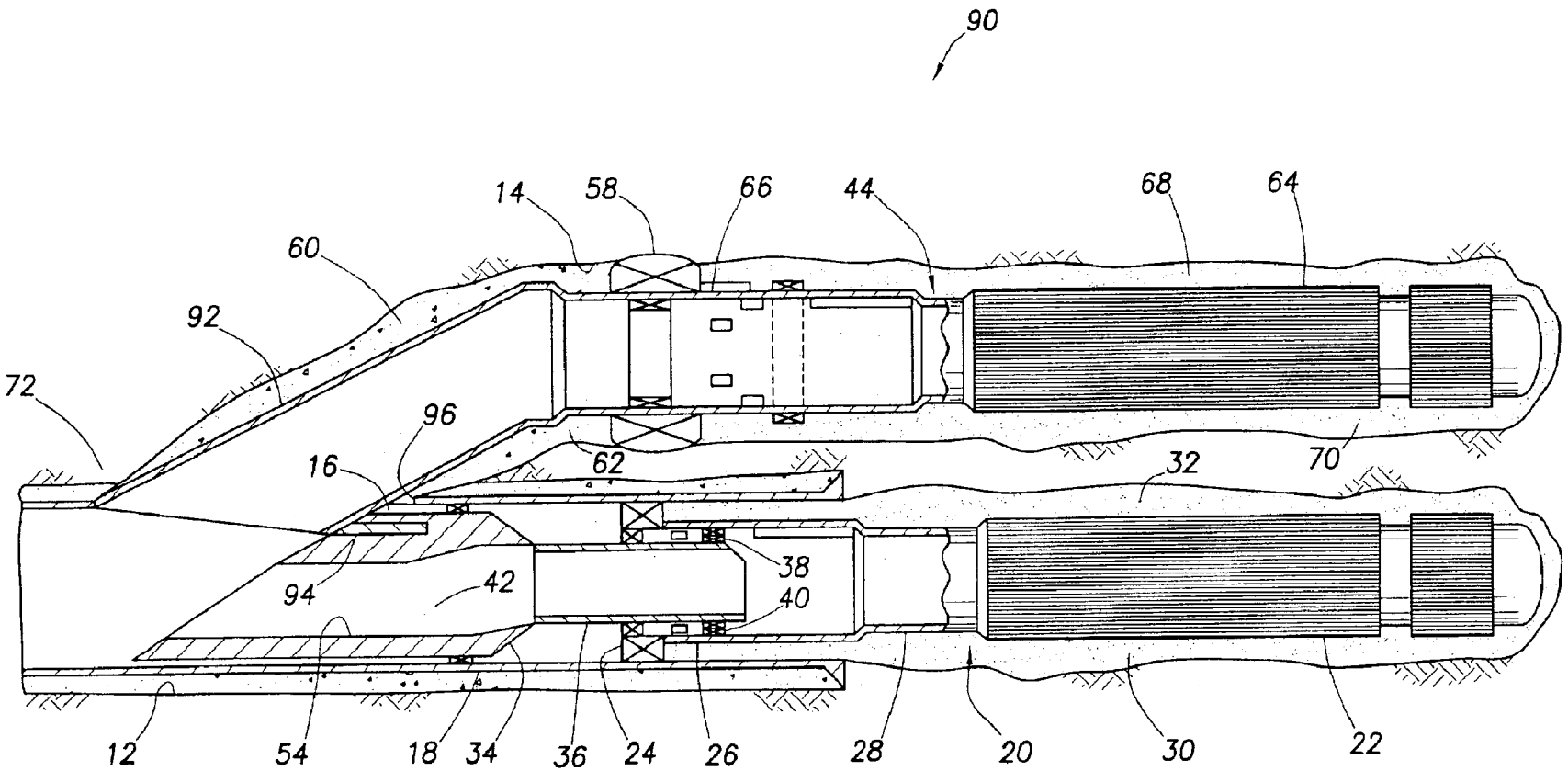
FIGS. 2A & B are schematic cross-sectional views of a second method embodying principles of the present invention.

Referring additionally now to FIGS. 2A & B, another method 90 embodying principles of the invention is schematically and representatively illustrated. The method 90 is somewhat similar to the method 10 described above, and so elements illustrated in FIGS. 2A & B which are similar to those previously described are indicated using the same reference numbers for convenience.

The method 90 differs from the method 10 in at least one significant respect in that the gravel packing assembly 44 is not conveyed into the well attached to the wellbore connector 48. Instead, after the lower portion of the wellbore 12 is completed as described above (installing the assembly 20 and gravel packing) and the deflector 34 is installed, the assembly 44 is conveyed into the well attached to a tubular string 92, such as a liner string. The deflector 34 deflects the assembly 44 laterally into the wellbore 14, and the assembly and the tubular string 92 are positioned in the wellbore as depicted in FIG. 2A.

Preferably, the tubular string 92 has attached thereto an engagement device 94 which engages the deflector 34 or another structure, such as the periphery of a window 96 formed through the casing 18 when the wellbore 14 was drilled. This engagement of the device 94 secures the tubular string 92 and assembly 44 in their proper position in the wellbore 14.

The packer 58 is inflated and the wellbore 14 is gravel packed about the assembly 44 as described above. The cement 60 may be placed in the annulus 62 about the tubular string 92, if desired.

Figure 2B:
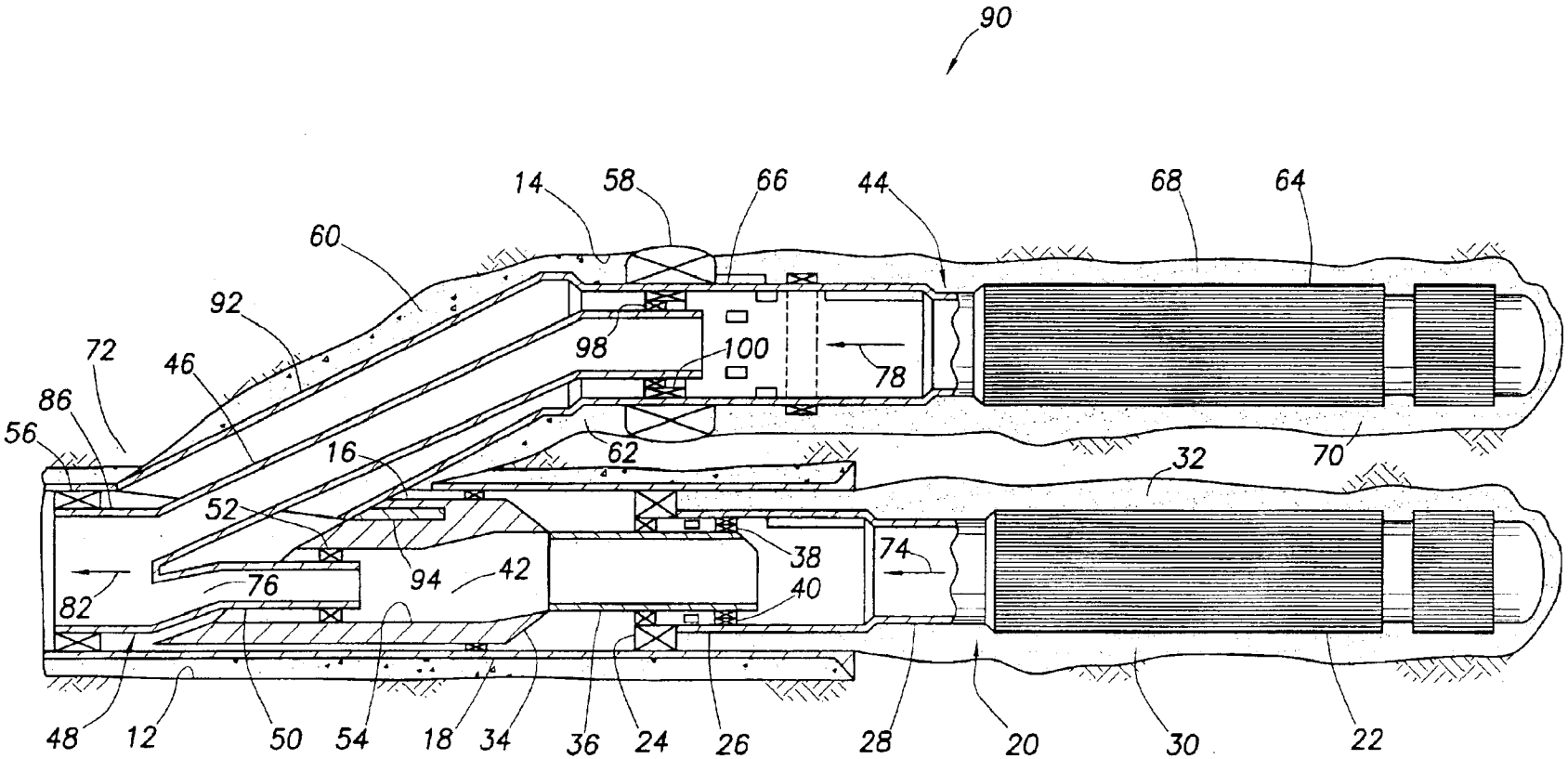

As depicted in FIG. 2B, the wellbore connector 48 is then installed. The longer leg 46 is deflected by the deflector 34 into the tubular string 92 in the wellbore 14. The longer leg 46 is sealed therein using seals 98 in seal bore 100. The shorter leg 50 stabs into the deflector passage 42 and seals therein as described above.

As with the method 10 described above, the method 90 provides isolation between the fluid flows 74, 78, 82 and the formation 72 surrounding the wellbore intersection 16. A TAML level 5 wellbore junction is, thus, achieved by the method 90 with a gravel packed completion in the branch wellbore 14, although two trips are used to complete the branch wellbore.

Note that it is not necessary in keeping with the principles of the invention for either or both of the wellbores 12, 14 to be gravel packed when completed. As described above for the method 10, the wellbores 12, 14 could be completed in some other manner, such as by using the screens 22, 64 without gravel packing, expanding the screens in the wellbores with or without also gravel packing, performing other completion operations, such as fracturing operations, etc. Thus, although gravel packed completions are described, the invention is not limited to these types of completions.

Referring additionally now to FIGS. 3A–F, another method 110 embodying principles of the invention is representatively and schematically illustrated. In some situations, completion techniques other than gravel packing may be desired for completing either or both of the intersecting wellbores. The method 110 uses expanded screens, rather than gravel packing, for sand control in each of the intersecting wellbores, but it should be understood that any completion technique, or any combination of completion techniques may be used, without departing from the principles of the invention.

Figure 3A:
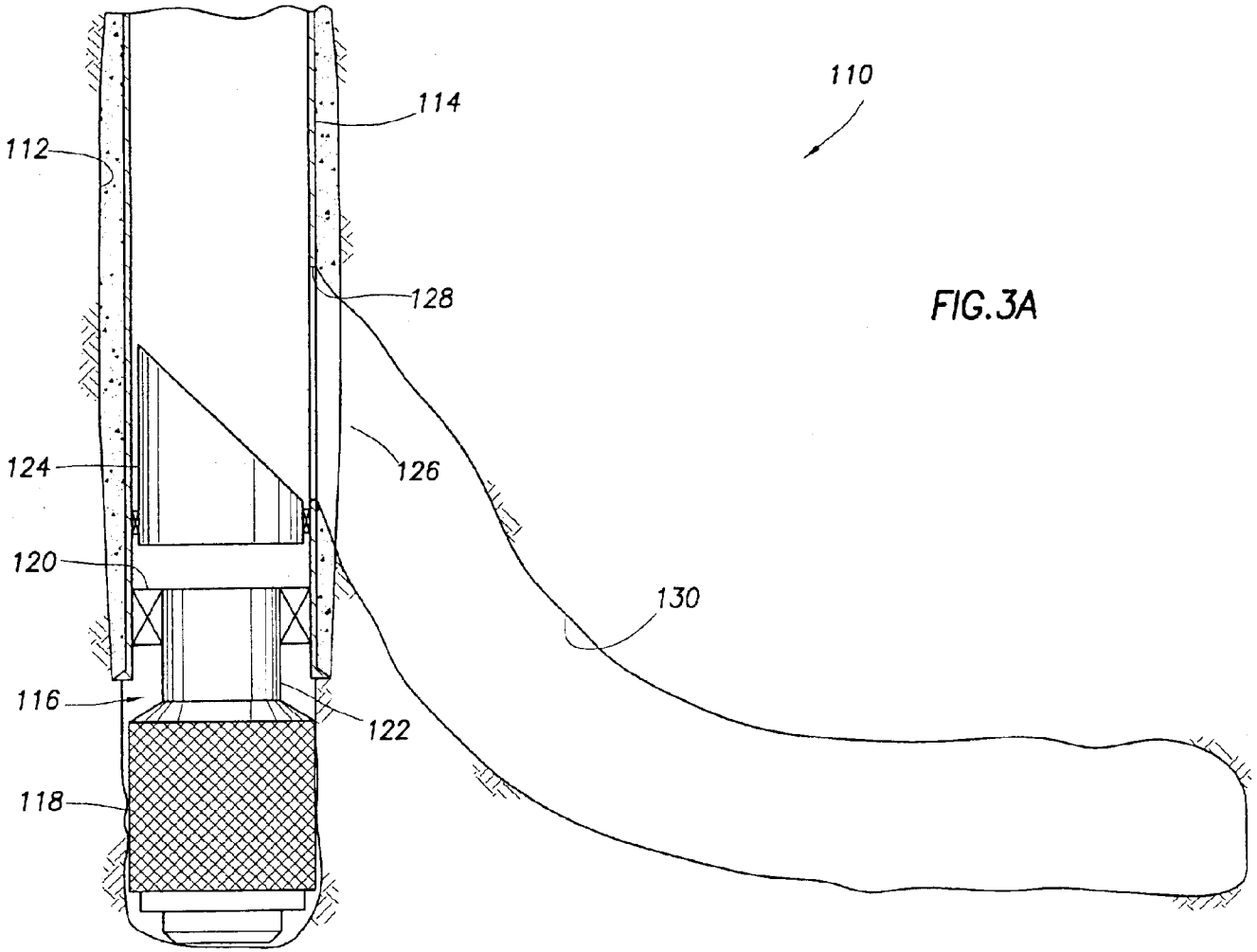
FIGS. 3A–F are schematic cross-sectional views of a third method embodying principles of the present invention.

In FIG. 3A, initial steps of the method 110 are depicted as having been performed in the well. A main or parent wellbore 112 is drilled and lined with casing 114. An open hole portion of the wellbore 112 is drilled through a lower end of the casing 114.

An assembly 116 including an expandable well screen 118 and a packer 120 interconnected in a tubular string 122 is positioned in the wellbore 112, so that the screen 118 is in the open hole portion of the wellbore and the packer 120 is in the cased portion of the wellbore. The packer 120 is set in the casing 114, and then the screen 118 is expanded outward using techniques well known to those skilled in the art. For example, the screen 118 may be swaged outward, inflated, unfolded, etc., in the wellbore 112. Preferably, after expansion the screen 118 contacts the walls of the wellbore 112, aiding in preventing collapse of the wellbore and enhancing sand control.

A milling/drilling whipstock 124 is then positioned in the wellbore 112 below a desired location for a wellbore intersection 126. Mills, drills, or other cutting tools are deflected laterally off of the whipstock 124 to form a window 128 through the casing 114, and to drill a lateral or branch wellbore 130 extending outwardly from the intersection 126. As stated above for the wellbores 12, 14 in the method to, it is not necessary for the wellbore 130 to extend laterally from the wellbore 112.

Figure 3B:
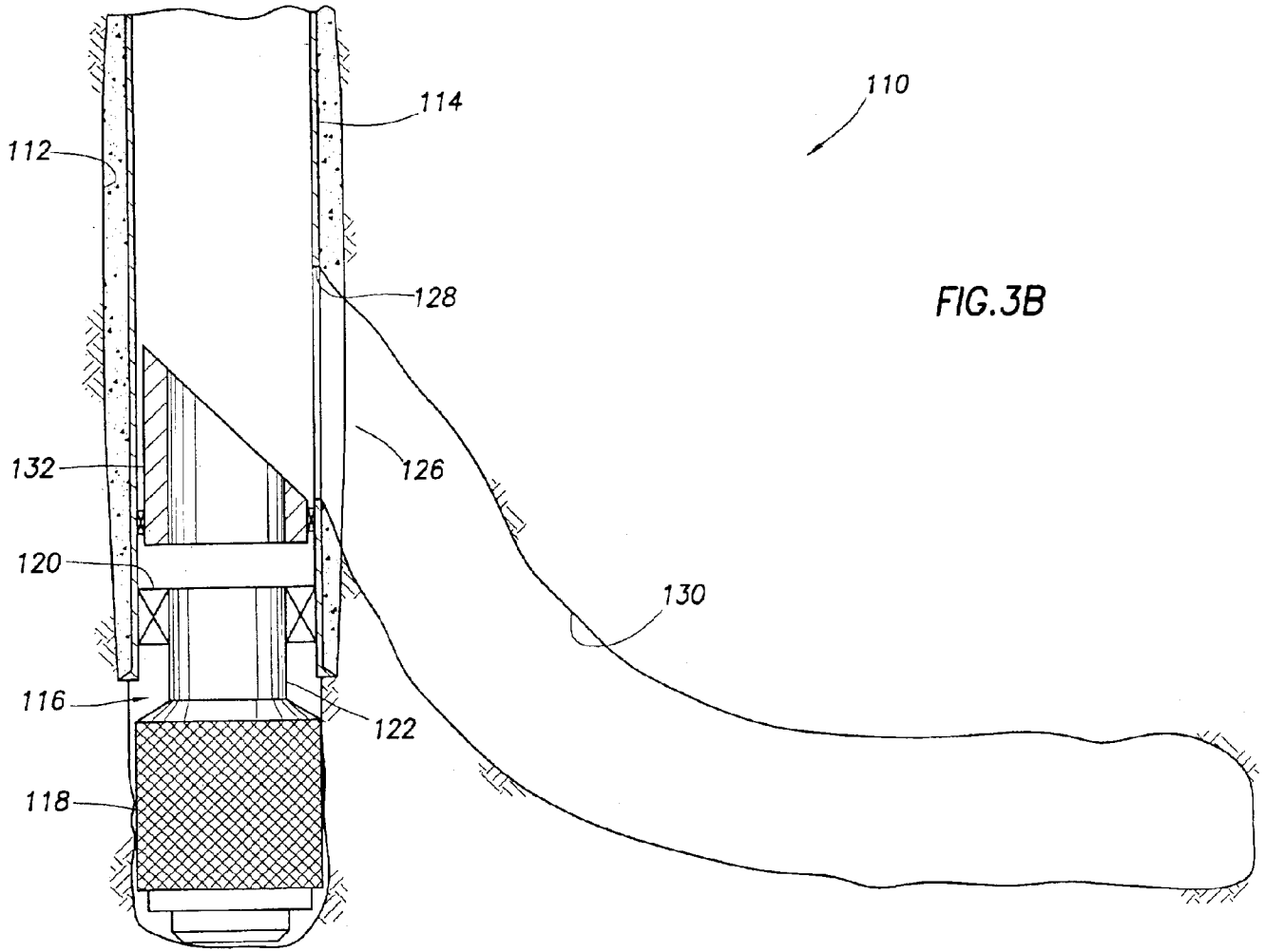
Figure 3C:
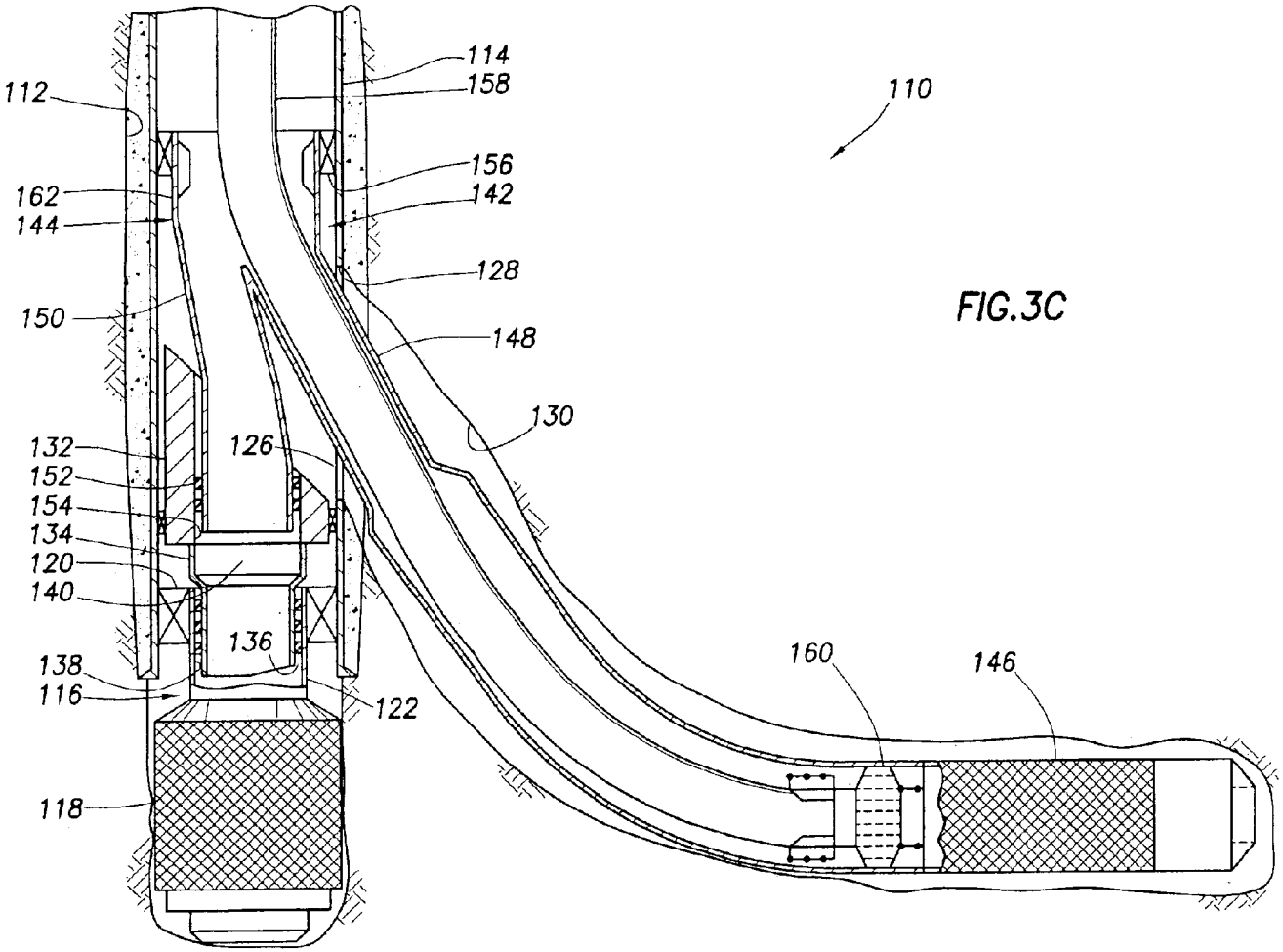

After drilling the wellbore 130, the whipstock 124 is retrieved and a deflector 132 is installed, as depicted in FIG. 3B. If desired, a tailpipe 134 may be attached below the deflector 132 and stabbed into the assembly 116 when the deflector is installed, as depicted in FIG. 3C. In that case, seals 136 may seal in a seal bore 138 to provide a sealed passage 140 for fluids produced through the assembly 116 into the deflector 132.

An assembly 142 including a wellbore connector 144 and an expandable well screen 146 is then conveyed into the well on a tubular string 158. The screen 146 is attached to a leg 148 of the wellbore connector 144 (via a tubular string 178 extending therebetween), and is deflected laterally into the wellbore 130 by the deflector 132. A shorter leg 150 of the wellbore connector 144 is stabbed into the passage 140, and is sealingly engaged therein, such as by using seals 152 received in a seal bore 154. A packer or hanger 156 attached to an upper tubular end 162 of the wellbore connector 144 may be used to secure and seal the wellbore connector 144 in the casing 114 above the window 128.

The tubular string 158 extends through the longer leg 148 of the wellbore connector 142. Attached at a lower end of the tubular string 158 is a screen expansion tool 160. After the assembly 142 is properly positioned in the well as depicted in FIG. 3C, the expansion tool 160 is used to outwardly expand the screen 146. For example, pressure applied through the tubular string 158 to the expansion tool 160 may cause the tool to outwardly deform the screen 146 in a manner known to those skilled in the art.

Figure 3D:
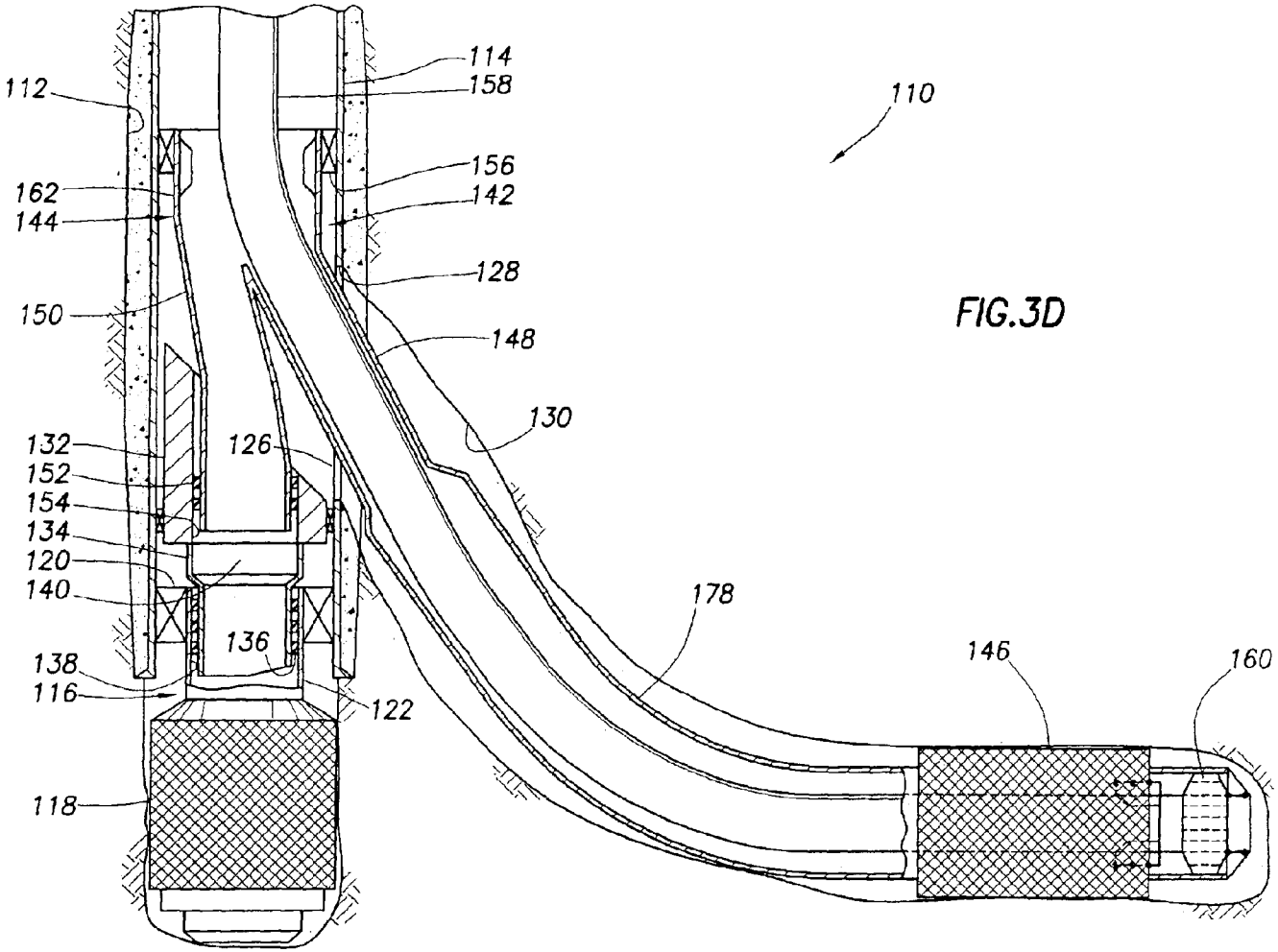

As depicted in FIG. 3D, the expansion tool 160 has displaced through and expanded the screen 146 outward in the wellbore 130. Preferably, the screen 146 contacts the walls of the wellbore 130 when it is expanded.

Figure 3E:
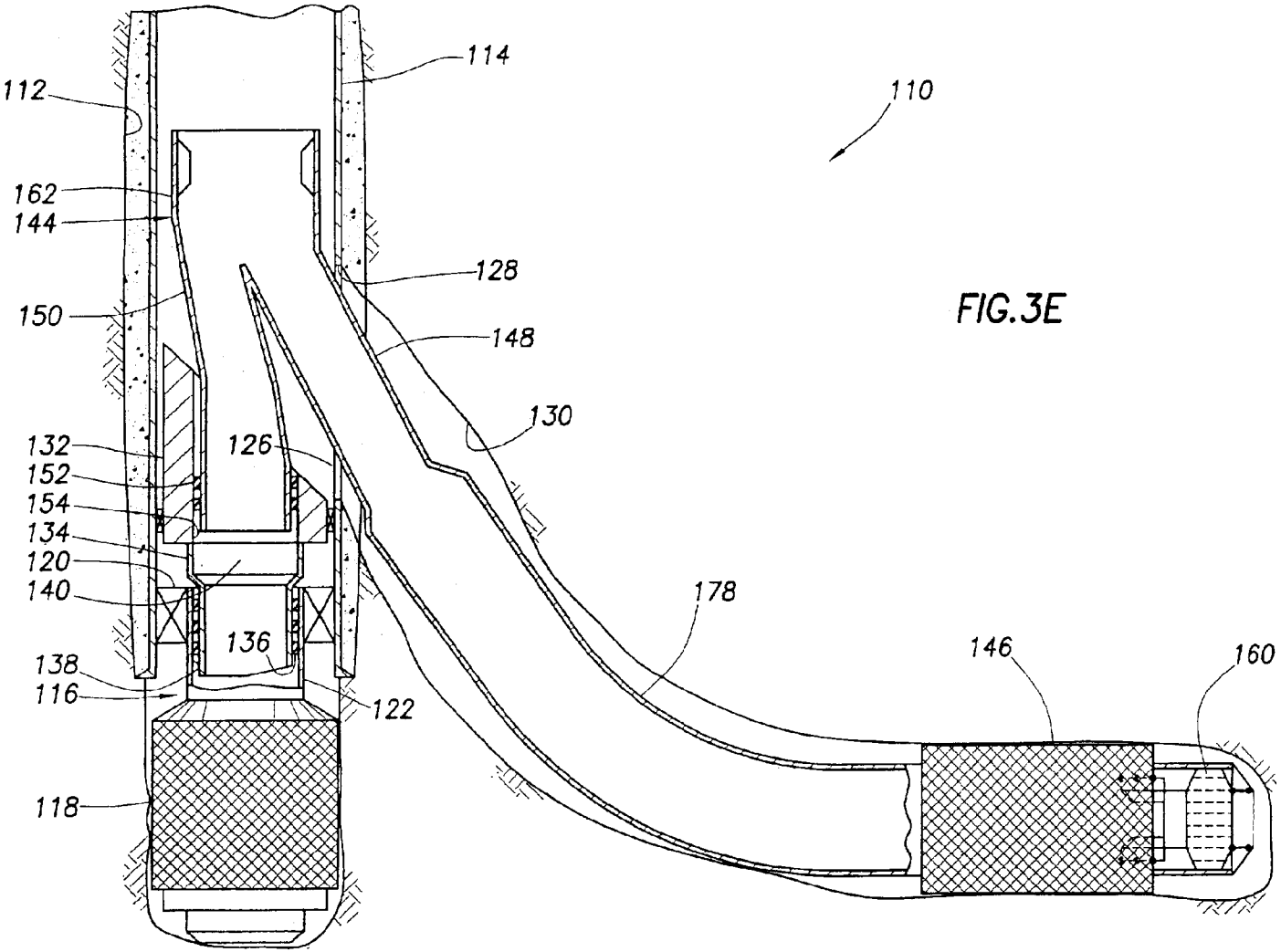

Note that the expander tool 160 may be too large to pass through the leg 148 after the screen 146 is expanded. In that case, the expander tool 160 may be left in the lower end of the assembly 142 after the screen 146 is expanded. For example, the expander tool 160 may be detached from the tubular string 158 and remain below the expanded screen 146 when the tubular string is retrieved from the well, as depicted in FIG. 3E. Otherwise, the expander tool 160 may be retrieved from the well along with the tubular string 158.

Figure 3F:
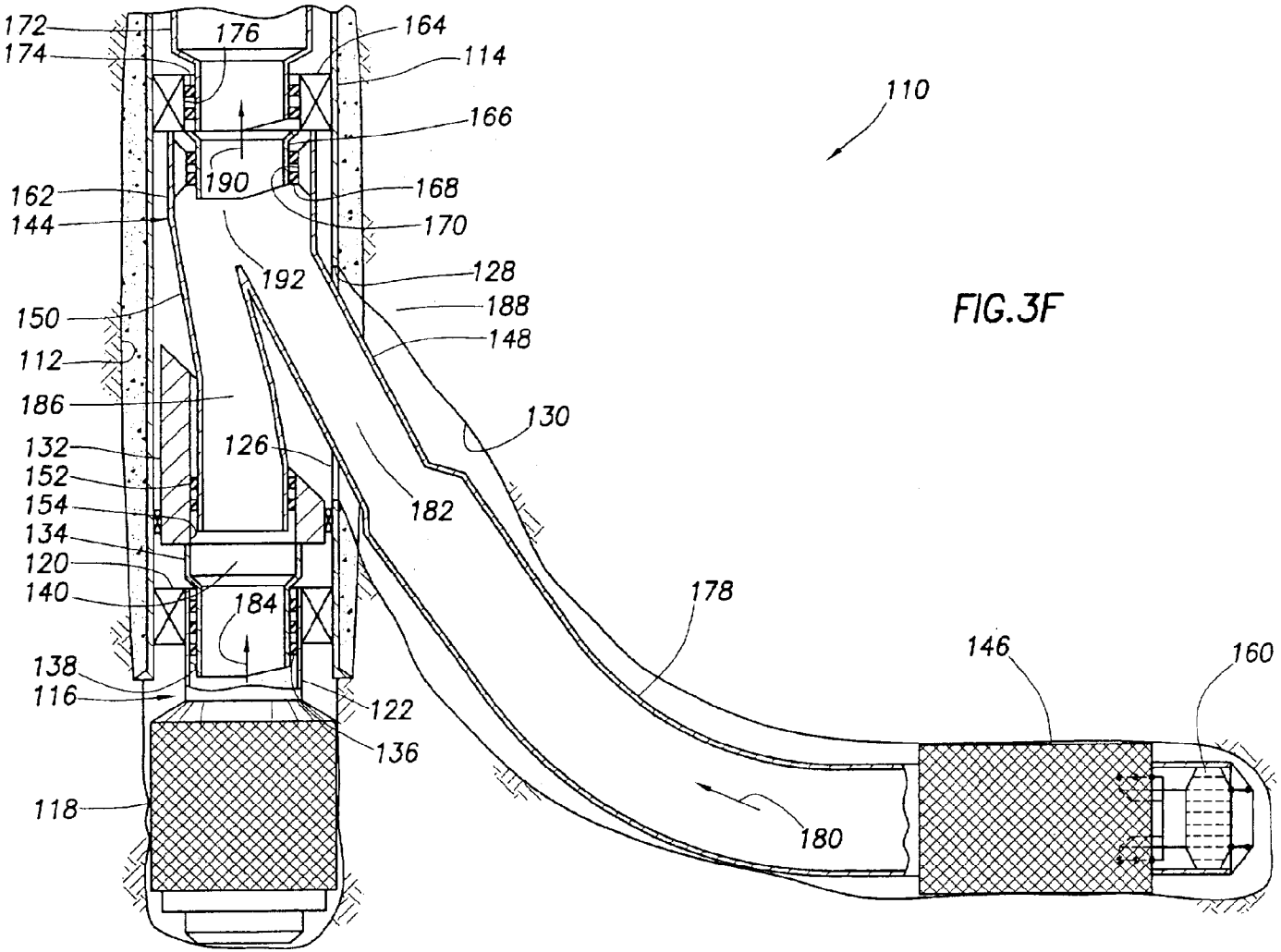

In FIG. 3E it may also be seen that it is not necessary for the packer 156 to be used on the upper end 162 of the wellbore connector 144. Instead, a packer 164 having a tailpipe 166 attached thereto may be installed after the tubular string 158 is retrieved from the well, as depicted in FIG. 3F. The tailpipe 166 is sealingly received in the upper end 162 of the wellbore connector 144, for example, using seals 168 received in a seal bore 170.

The packer 164 is set in the casing 114. After setting the packer 164, a production tubing string 172 is stabbed into the packer 164 and sealingly received therein, for example, using seals 174 received in a seal bore 176.

It may now be fully appreciated that the method 10 provides for a sand control completion in the branch wellbore 130 in a single trip into the well, and also provides a TAML level 5 wellbore junction. Sand control in the wellbores 112, 130 is provided using expanded screens 118, 146. Note that zonal isolation may be achieved in the branch wellbore 130 by using a packer interconnected in the tubular string 178 between the screen 146 and the leg 148, if desired.

Fluid (indicated by arrow 180) can now flow into a passage 182 in the leg 148 from the branch wellbore 130, and fluid (indicated by arrow 184) can now flow into a passage 186 in the leg 150 from the lower parent wellbore 112, and be commingled in the wellbore connector 144 isolated from the wellbore intersection 126 and a formation 188 surrounding the intersection. The commingled fluids (indicated by arrow 190) can then flow through a passage 192 in the upper end 162 of the wellbore connector 144 and into the tubular string 172 for production to the surface.

Expandable screens, such as the screens 118, 146 may also be used in the methods 10, 90 depicted in FIGS. 1 and 2A & B. For example, instead of, or in addition to, gravel packing about the screens 22 and/or 64, expandable screens may be used to provide sand control.

In the method 90, this use of an expandable screen may be accomplished in the branch wellbore 14 by expanding the screen 64 using any technique (such as swaging, inflating, unfolding, etc.), after the assembly 44 is installed, but prior to installing the wellbore connector 48. This would eliminate the need for the discharge device 66 and other gravel packing devices in the assembly 44, unless it is also desired to gravel pack prior to expanding the screen 64. Similarly, the screen 22 could be expanded in the other wellbore 12.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well completion, comprising:

first and second wellbores intersecting at an intersection;

an assembly positioned in the second wellbore, the assembly including a packer and a well screen, the packer being sealingly engaged with the second wellbore; and a wellbore connector sealingly connected to the assembly, the wellbore connector also being sealingly engaged in the first wellbore on opposite sides of the intersection, and the wellbore connector isolating the intersection from fluid flow through the assembly in the second wellbore and from fluid flowing through the wellbore connector between the opposite sides of the intersection, and wherein the assembly and the wellbore connector are installed together in a single trip.

2. The well completion according to claim 1, wherein the packer is set in the second wellbore between the screen and the intersection.

3. The well completion according to claim 1, wherein the assembly further includes a slurry discharge device positioned between the packer and the screen.

4. The well completion according to claim 1, further comprising gravel disposed in an annulus between the screen and the second wellbore.

5. The well completion according to claim 1, further comprising cement disposed in an annulus between the wellbore connector and the second wellbore.

6. The well completion according to claim 5, wherein the cement is positioned at least partially between the packer and the intersection.

7. The well completion according to claim 1, wherein the wellbore connector includes first, second and third intersecting flow passages, the first passage receiving fluid from the second and third passages, the second passage receiving fluid from the assembly, and the third passage receiving fluid from the first wellbore.

8. The well completion according to claim 1, wherein a tubular leg of the wellbore connector is sealingly connected to a gravel packing assembly positioned in the first wellbore.

9. The well completion according to claim 8, wherein the leg is sealingly received in a deflector positioned in the first wellbore.

10. The well completion according to claim 9, wherein the deflector is sealingly connected to the gravel packing assembly.

11. The well completion according to claim 1, wherein the assembly further includes a tubular string extending between the packer and the intersection.

12. The well completion according to claim 11, further comprising cement disposed in an annulus between the tubular string and the second wellbore.

13. The well completion according to claim 11, wherein the tubular string is attached to a deflector positioned in the first wellbore.

14. The well completion according to claim 13, wherein the wellbore connector is sealingly connected to the deflector.

15. The well completion according to claim 11, wherein the wellbore connector is sealingly connected to a deflector in the first wellbore, and the deflector is sealingly connected to a gravel packing assembly in the first wellbore.

16. The well completion according to claim 1, wherein the well screen is expanded within the second wellbore.

17. A well completion, comprising:

first and second wellbores intersecting at an intersection;

an expandable well screen positioned in the second wellbore; and a wellbore connector connected to the screen, the wellbore connector also being sealingly engaged in the first wellbore on opposite sides of the intersection, and the wellbore connector isolating the intersection from fluid flow through the screen in the second wellbore and from fluid flowing through the wellbore connector between the opposite sides of the intersection, and wherein the screen and the wellbore connector are installed together in a single trip.

18. The well completion according to claim 17, further comprising a screen expander tool in the second wellbore, the tool being operative to expand the screen in the second wellbore.

19. The well completion according to claim 18, wherein the expander tool is connected to a tubular string extending through the wellbore connector.

20. The well completion according to claim 18, wherein the screen is expanded to an enlarged configuration in the second wellbore.

* * * * *